US011885192B1

(12) United States Patent
Alsultan et al.

(10) Patent No.: US 11,885,192 B1
(45) Date of Patent: Jan. 30, 2024

(54) WIRELINE JARRING TOOL AND METHODS OF USE

(71) Applicant: SAUDI ARABIAN OIL COMPANY, Dhahran (SA)

(72) Inventors: Fouad A. Alsultan, AlAhsa (SA); Hathaal Mubarak A. Alburaik, Udhailiyah (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/051,069

(22) Filed: Oct. 31, 2022

(51) Int. Cl.
*E21B 31/107* (2006.01)

(52) U.S. Cl.
CPC ..... *E21B 31/107* (2013.01)

(58) Field of Classification Search
CPC ..... E21B 23/001; E21B 31/107
See application file for complete search history.

(56) References Cited

U.S. PATENT DOCUMENTS 2,185,303 A * 1/1940 Kinley ..... E21B 29/02 83/53
2,207,649 A 7/1940 Williams et al.
2,762,438 A 9/1956 Naylor
2,832,423 A 4/1958 Hall
3,926,252 A * 12/1975 Ribeyre ..... E21B 29/04 114/221 A
4,427,059 A * 1/1984 Olivier ..... E21B 29/04 166/54.6
6,109,373 A * 8/2000 Able ..... E21B 31/18 166/178
6,851,215 B2 2/2005 Conrad
6,991,035 B2 1/2006 Hall et al.
8,176,986 B2 5/2012 Warren et al.
8,899,330 B2 * 12/2014 Misselbrook ..... E21B 29/04 166/54.5
9,010,427 B2 4/2015 Macrae et al.
2012/0247756 A1 * 10/2012 Taylor ..... E21B 33/1285 166/241.5
2013/0199790 A1 * 8/2013 Themig ..... E21B 34/14 166/305.1
2014/0360724 A1 * 12/2014 Laird ..... E21B 31/002 166/99
2015/0114643 A1 * 4/2015 McNeilly ..... E21B 31/107 166/301
2015/0211318 A1 7/2015 Redlinger et al.
2015/0240596 A1 * 8/2015 Horwell ..... E21B 34/102 166/332.8
2020/0340321 A1 * 10/2020 Moyes ..... E21B 31/005

* cited by examiner

*Primary Examiner* — Shane Bomar
(74) *Attorney, Agent, or Firm* — Vorys, Sater, Seymour, and Pease LLP

(57) ABSTRACT

A wireline jarring tool includes an elongate body having opposing upper and lower ends, a longitudinal channel defined in the elongate body and extending between the upper and lower ends and sized to loosely receive a wireline, and a jarring assembly housed within the elongate body and operable to generate a jarring force transmittable to a bottom hole assembly (BHA) once the wireline jarring tool is secured to the BHA within a wellbore. The wireline jarring tool is conveyable into the wellbore by translating longitudinally along the wireline, and actuating the jarring assembly is configured to release the BHA from a stuck position within a wellbore.

20 Claims, 7 Drawing Sheets

WIRELINE JARRING TOOL AND METHODS OF USE

FIELD OF THE DISCLOSURE

The present disclosure relates generally to wireline and slickline operations and, more particularly, to a wireline jarring tool for downhole jarring operations.

BACKGROUND OF THE DISCLOSURE

In the oil and gas industry, wirelines and slicklines (cooperatively referred to herein as "wirelines") are used for a wide variety of purposes throughout the various phases of hydrocarbon exploration and production activities, including well diagnostics, well perforation, completions, abandonment, change zone operations, and other operations. Wirelines are also often used to place and retrieve well equipment such as plugs, gauges, and valves.

While uncommon, downhole tools and bottom hole assemblies or "BHAs" (cooperatively referred to herein as "BHAs") designed to be run downhole on wireline can sometimes become stuck within the wellbore. To free the tool, a jarring tool is commonly included in the BHA and actuated to "jar" the tool loose. In some wireline operations, however, such as when running a pressure gauge to measure downhole pressure in the wellbore, normal wireline jarring tools are not included as part of the BHA, since such tools might cause gauge faults if unintentionally activated. In such a scenario, the wireline is typically severed (cut) at the upper end of the BHA and a jarring tool is subsequently conveyed downhole to locate, engage, and forcefully retrieve the stuck BHA. In such operations, the stuck BHA is referred to as a "fish," and sending the jarring tool downhole is referred to as a "fishing expedition" or "fishing operation."

Since fishing operations can be complex and require costly rig operation to retrieve the fish and operate the well safely, an improved wireline jarring tool is desired.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, A well system, includes a wellhead, including a lubricator and a wireline extending through the lubricator, a bottom hole assembly (BHA) attached to the wireline and conveyable into a wellbore extending from the wellhead, and a wireline jarring tool. The wireline jarring tool includes an elongate body having opposing upper and lower ends, a longitudinal channel defined in the elongate body and extending between the upper and lower ends and sized to loosely receive the wireline, and a jarring assembly housed within the elongate body and operable to generate a jarring force transmittable to the BHA once the wireline jarring tool is secured to the BHA. The wireline jarring tool is conveyable into the wellbore by translating longitudinally along the wireline, and actuating the jarring assembly is configured to release the BHA from a stuck position within the wellbore.

In another embodiment, a method of jarring a bottom hole assembly (BHA), includes installing a wireline jarring tool onto a wireline extending from a wellhead into a wellbore extending from the wellhead, the BHA being coupled to a distal end of the wireline within the wellbore, dropping the wireline jarring tool into the wellbore and allowing the wireline jarring tool to translate longitudinally along the wireline until locating the BHA, mating the wireline jarring tool with the BHA, and actuating a jarring assembly included in the wireline jarring tool and thereby transmitting a jarring force to the BHA.

In a further embodiment, a wireline jarring tool includes an elongate body having opposing upper and lower ends, a longitudinal channel defined in the elongate body and extending between the upper and lower ends and sized to loosely receive a wireline, and a jarring assembly housed within the elongate body and operable to generate a jarring force transmittable to a bottom hole assembly (BHA) once the wireline jarring tool is secured to the BHA within a wellbore. The wireline jarring tool is conveyable into the wellbore by translating longitudinally along the wireline, and actuating the jarring assembly is configured to release the BHA from a stuck position within a wellbore.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
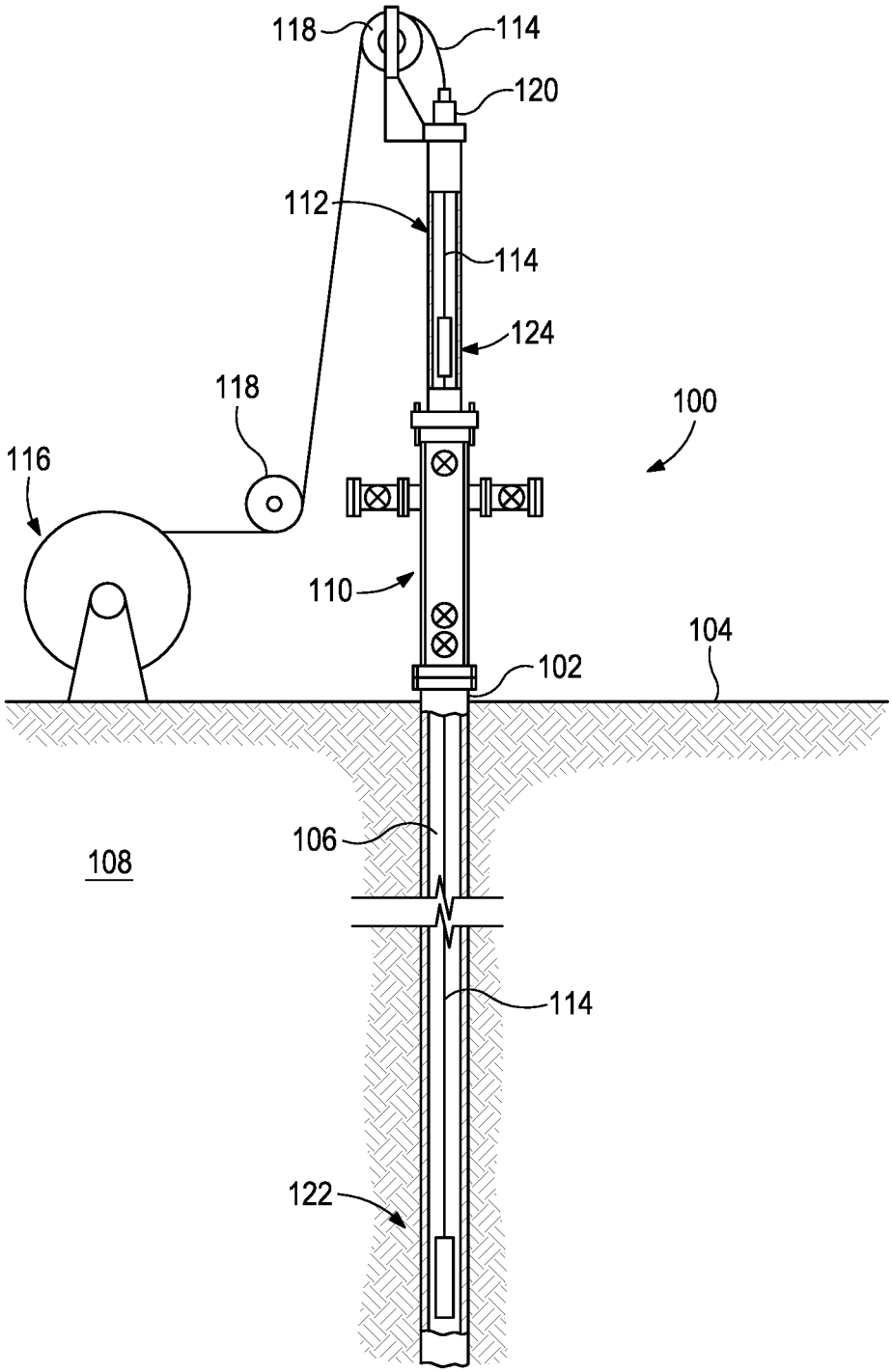
FIG. 1 is a schematic view of an example well system that may incorporate the principles of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to wireline and slickline operations and, more particularly, to a wireline jarring tool for downhole jarring operations. The wireline jarring tools described herein may be used during any wireline operation to provide jarring capabilities in the event of a downhole tool or bottom hole assembly (BHA) becoming stuck within a wellbore. The additional jarring capability provided by the wireline jarring tools described herein will support the release of stuck BHAs to be retrieved from the wellbore and may aid in avoiding the requirement of future fishing operations.

FIG. 1 is a schematic view of an example well system 100 that may incorporate the principles of the present disclosure. As illustrated, the well system 100 (hereafter "the system 100") includes a wellhead 102 installed at a surface location 104, such as the Earth's surface, and a wellbore 106 extends from the wellhead 102 and penetrates one or more subterranean formations 108. The wellbore 106 may be cased, open hole, contain tubing, and/or may generally be characterized as a hole in the ground having a variety of shapes and/or geometries as are known to those of skill in the art. While the system 100 is depicted in FIG. 1 as a land-based system, the principles described herein are equally applicable to subsea operations that employ floating or sea-based platforms and rigs, without departing from the scope of the disclosure.

The system 100 may be configured for downhole wireline operations and interventions. More specifically, the system 100 may include a blowout preventer (BOP) 110 operatively coupled to (e.g., bolted or clamped) the wellhead 102, and a lubricator 112 may be operatively coupled to (e.g., bolted or clamped) the BOP 110. While not shown, additional components may be positioned between the BOP 110 and the wellhead 102 or between the BOP 110 and the lubricator 112, such as a casing head spool, a tubing head spool, etc. Accordingly, the example arrangement of the wellhead 102, the BOP 110, and the lubricator 112 in FIG. 1 should not be considered a limitation of the present disclosure, but instead many variations of said arrangement may be included in the system 100, without departing from the scope of the disclosure.

The BOP 110 may include a plurality of valves operable to control hydrocarbon production from the subterranean formation(s) 108. The lubricator 112 may be an elongate, high-pressure pipe or tubular fitted to the top of the BOP 110 and configured to provide a means for introducing downhole tools and assemblies into the wellbore 106 via slickline or wireline 114. The lubricator 112 is a pressure-controlled device used to initially house downhole tools and assemblies and create a seal between the outside environment and the pressurized environment in the well.

The wireline 114 may be coiled (wound) onto a large drum 116 and routed through one or more pulleys or sheaves 118 to be introduced into the lubricator 112 at a stuffing box 120 provided at the top of the lubricator 112. The stuffing box 120 comprises a high-pressure grease-injection section and includes various sealing elements used to seal about the wireline 114 as it is fed into and out of the lubricator 112. A wireline operator rotates the drum 116 to alternately lower (unspool) or raise (spool) the wireline 114.

The system 100 may also include a downhole tool or bottom hole assembly (BHA) 122 configured to be introduced into the wellbore 106 to undertake one or more downhole operations. The BHA 122 may comprise a variety of downhole tools, devices, mechanisms, and assemblies capable of completing a variety of downhole operations. In some embodiments, the BHA 122 may comprise a single downhole tool, but could alternatively comprise a tool string or bottom hole assembly (BHA) comprised of multiple tools and/or devices arranged in series. Examples of the BHA 122 include, but are not limited to, a fluid sampler, a completion tool, a drilling tool, a stimulation tool, an evaluation tool, a safety tool, an abandonment tool, a packer, a bridge plug, a setting tool, a perforation gun, a casing cutter, a flow control device, a sensing instrument, a data collection device and/or instrument, a measure while drilling (MWD) tool, a log while drilling (LWD) tool, a drill bit, a reamer, a stimulation tool, a fracturing tool, a production tool, combinations thereof, and the like.

To convey the BHA 122 into the wellbore 106, the BHA 122 is coupled to the wireline 114 and placed within the lubricator 112. The lubricator 112 is then pressurized to at or above wellbore 106 pressure, and once properly pressurized, one or more of the valves on the BOP 110 is opened to enable the BHA 122 to descend into the wellbore 106 on the wireline 114 via the BOP 110. In some embodiments, the BHA 122 simply falls into the wellbore 106 on the wireline 114 under gravitational forces. In other embodiments, however, the BHA 122 may be pumped into the wellbore 106 on the wireline 114 under pressure. To remove the BHA 122 from the wellbore 106, the wireline 114 is retracted and the installation process is reversed.

In FIG. 1, the BHA 122 is shown arranged downhole within the wellbore 106. In some applications, the BHA 122 may become stuck or lodged within the wellbore 106 for a variety of reasons. In such cases, if the BHA 122 cannot be jarred loose using rig force or a jarring tool included in the BHA 122, the wireline 114 may have to be severed (cut) and a fishing operation subsequently undertaken to retrieve the BHA 122.

According to embodiments of the present disclosure, the system 100 may include a wireline jarring tool 124 designed to be deployed downhole to provide jarring forces to the BHA 122 in the event the BHA 122 becomes stuck within the wellbore 106. The wireline jarring tool 124 is designed to be coupled to and conveyed downhole on the wireline 114 already connected to the BHA 122. As described in more detail below, the wireline jarring tool 124 may be loosely mounted to the wireline 114 within the lubricator 112, and thus able to drop (fall) into the wellbore 106 under gravitational forces using the wireline 114 as a guide. Upon locating and attaching to the BHA 122, the wireline jarring tool 124 may then be actuated (activated) to jar the BHA 122 loose.

Figure 2B:
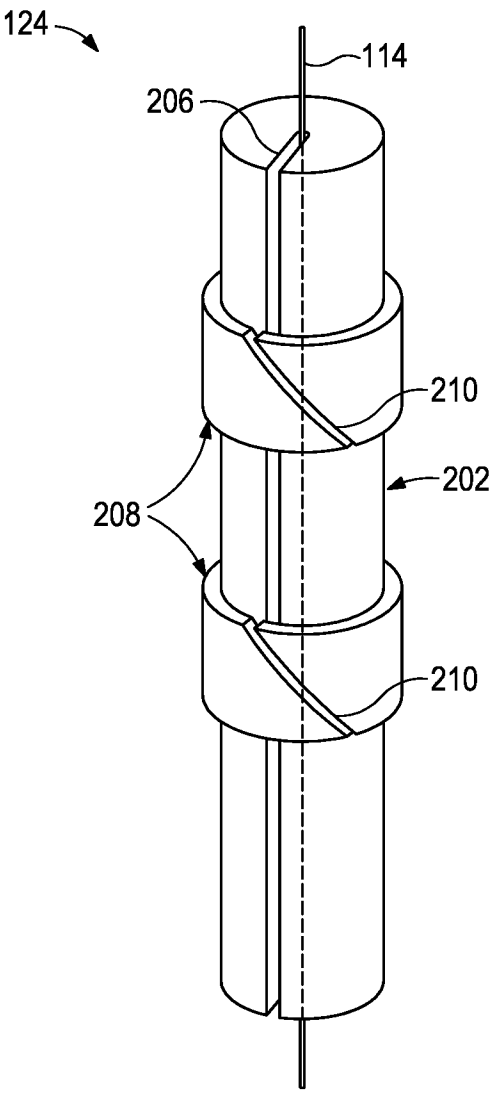
FIGS. 2A and 2B are exploded and assembled views, respectively, of an example of the wireline jarring tool of FIG. 1, according to one or more embodiments.
Figure 2A:
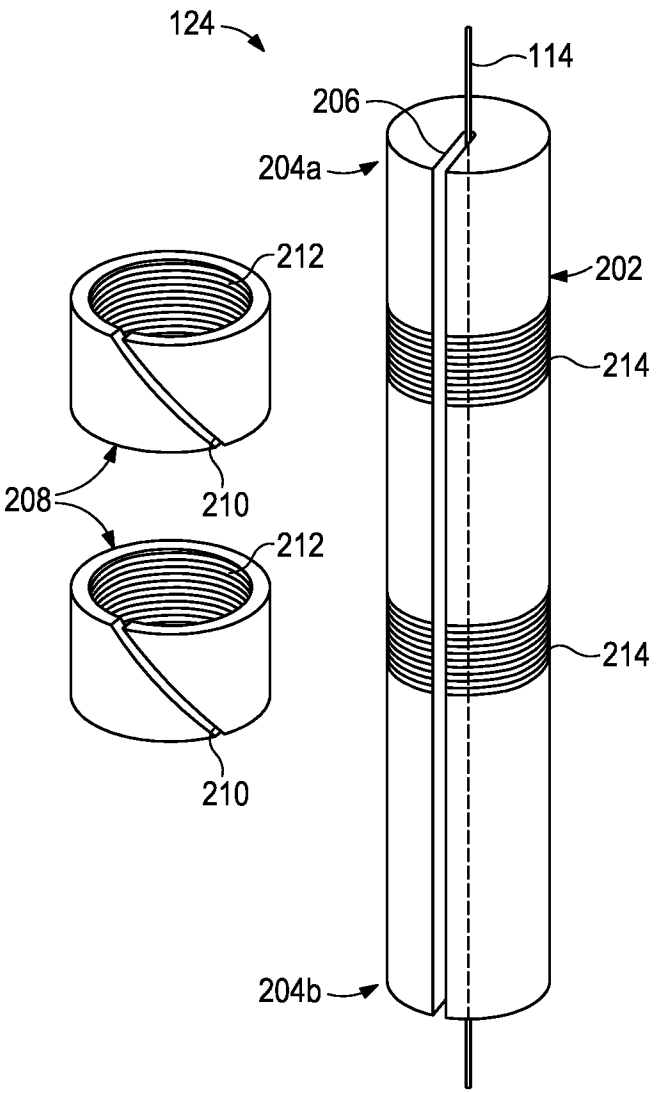

FIGS. 2A and 2B are exploded and assembled views, respectively, of an example of the wireline jarring tool 124, according to one or more embodiments. As illustrated, the wireline jarring tool 124 has an elongate body 202 having a first or "upper" end 204*a* and a second or "lower" end 204*b* opposite the upper end 204*a*. The body 202 may be generally cylindrical in shape and, in some embodiments, may exhibit a generally circular cross-section, but could alternatively exhibit other cross-sectional shapes, such as polygonal.

A longitudinal channel 206 may be defined in the body 202 and extend between the upper and lower ends 204*a,b*. In some embodiments, the longitudinal channel 206 extends from the outer circumference of the body 202 to the centerline of the body 202. The longitudinal channel 206 may be sized to receive the wireline 114, and the wireline 114 may be loosely or freely received within the longitudinal channel 206 such that the wireline jarring tool 124 is able to translate longitudinally along the wireline 114 without substantially gripping the wireline 114. This will allow the wireline jarring tool 124 to freely drop (fall) into the wellbore 106 (FIG. 1) under gravitational forces using the wireline 114 as a guide. As described below, however, the wireline jarring tool 124 may include a braking mechanism that is selectively operable to grip the wireline 114 and thereby slow or stop movement of the wireline jarring tool 124.

To maintain the wireline 114 within the body 202, the wireline jarring tool 124 may include one or more locking caps 208 (two shown) configured to prevent the wireline 114 from migrating out of the longitudinal channel 206 during operation. While two locking caps 208 are shown in FIG. 1, more or less than two may be employed, without departing from the scope of the disclosure. As illustrated, each locking cap 208 comprises a generally annular ring. The locking caps 208 may be configured to be secured to the body 202 and, more particularly, to the outer radial surface of the body 202. In some embodiments, as illustrated, the locking caps 208 may be secured to the body 202 at corresponding intermediate locations along the axial length of the body 202. In other embodiments, however, one or both of the locking caps 208 may be secured at or near the upper and lower ends 204*a,b*, respectively.

The locking caps 208 may be secured to the body 202 via a variety of attachment means and mechanisms. In the illustrated embodiment, for example, the locking caps 208 may be threaded to the body 202. In such embodiments, the locking caps 208 may define internal threads 212 configured to threadably mate with corresponding external threads 214 provided on the body 202. Those skilled in the art will readily appreciate that this threaded interface may be replaced with (or supplemented with) other types of mechanical attachment means such as, but not limited to, a snap fit engagement, one or more tabs, an interference fit, an adhesive, welding, a clamshell clasping mechanism, or any combination thereof.

To secure the wireline 114 within the longitudinal channel 206, the wireline must pass through the locking caps 208 to access the longitudinal channel 206. To accomplish this, the locking caps 208 may define a slanted wire entry 210 that forms a break in the locking cap 208. The slanted wire entry 210 allows the wireline 114 to pass through the annular structure of the corresponding locking cap 208 to thereby locate the longitudinal channel 206, but simultaneously provides a torturous pathway that prevents the wireline 114 from inadvertently escaping the longitudinal channel 206 during operation. In at least one embodiment, once the wireline 114 is received within the longitudinal channel 206, the locking caps 208 may be rotated to misalign the slanted wire entry 210 with the longitudinal channel 206, thus removing the possibility of the wireline 114 somehow reversing course through the slanted wire entry 210 to escape the longitudinal channel 206.

In FIG. 2B, the locking caps 208 are depicted as installed on (secured to) the outer surface of the body 202. The wireline 114 is received within the longitudinal channel 206 by passing through the locking caps 208 at the corresponding slanted wire entries 210. Further, the locking caps 208 have been secured to the body 202 of the wireline jarring tool 124 using the internal and external threads 212, 214. With the locking caps 208 in place, the wireline 114 should be secured within the body 202, such that the wireline 114 is unable to reverse course out of the longitudinal channel 206 by passing through the slanted wire entry 210 while in use.

Following operation and retrieval of the wireline jarring tool 124, the wireline 114 may be slacked such that the wireline 114 may pass through the slanted wire entry 210 in reverse, thus removing the wireline jarring tool 124 from the wireline 114. Or the locking caps 208 may instead be removed (unthreaded) from the body 202 of the wireline jarring tool 124 and separately removed from the wireline 114. This may prove advantageous in facilitating the reusability of the wireline jarring tool 124, including the locking caps 208.

Figure 3:
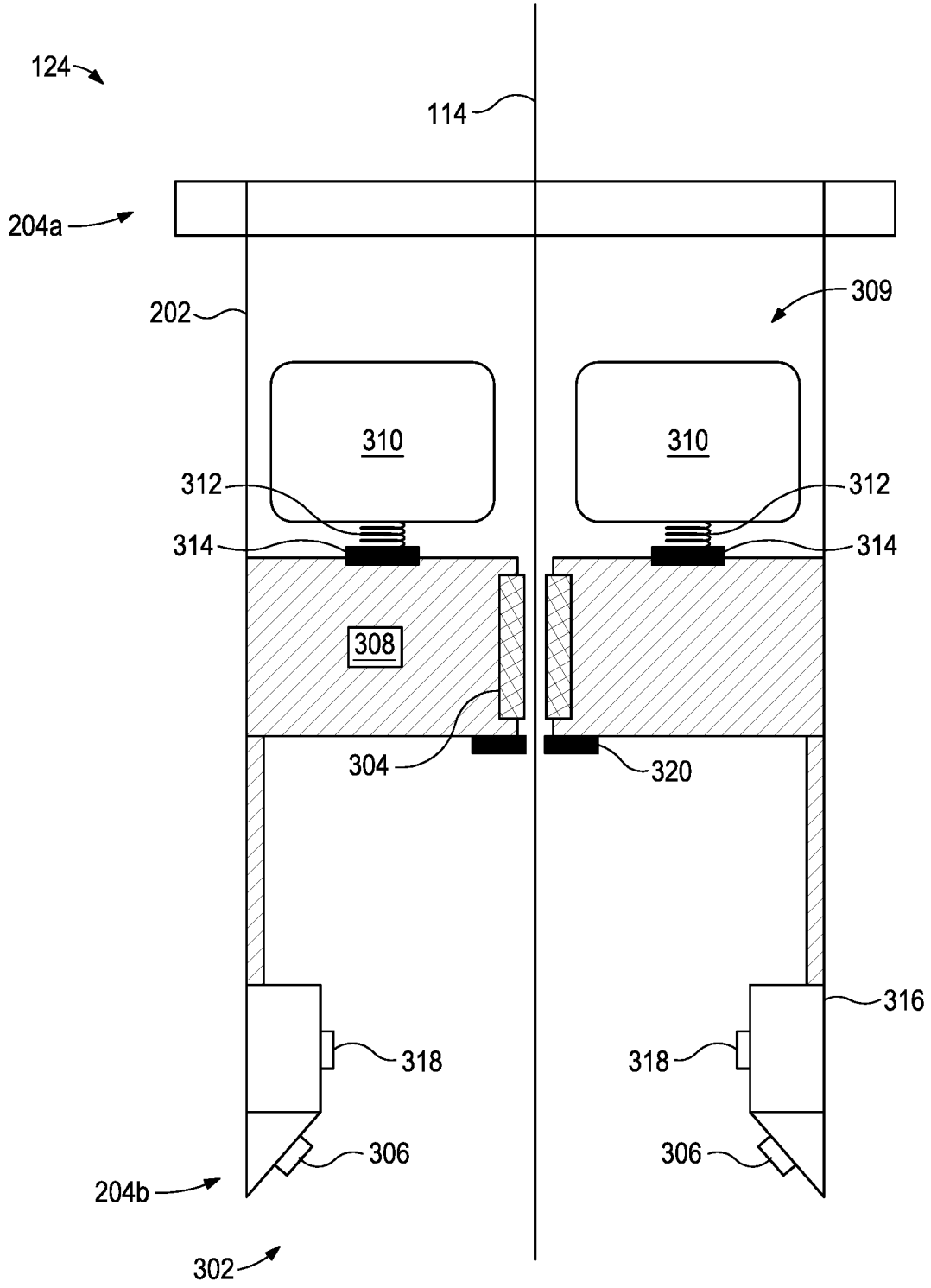
FIG. 3 is a cross-sectional side view of the wireline jarring tool of FIGS. 2A-2B, according to one or more embodiments.

FIG. 3 is a cross-sectional side view of the wireline jarring tool 124, according to one or more embodiments. The wireline jarring tool 124 is depicted in FIG. 3 as installed on the wireline 114, and the wireline 114 otherwise extends through the interior of the wireline jarring tool 124. The upper end 204*a* may include or define a fish neck similar to that of the BHA 122 and other downhole tools, such that the wireline jarring tool 124 may be fished out in the event that it is lost within the wellbore 106. As illustrated, the upper end 204*a* may be generally closed (except for where the wireline 114 passes therethrough) and the lower end 204*b* may be open and otherwise define an opening referred to herein as a fish neck housing 302. The fish neck housing 302 may comprise, for example, a tool guide surface sized and otherwise configured to receive and mate with an upper end of the BHA 122 (FIG. 1), which may be stuck in the wellbore 106 (FIG. 1).

After installation onto the wireline 114, the wireline jarring tool 124 may be released from the lubricator 112 (FIG. 1) and allowed to descend into the wellbore 106 (FIG. 1) on the wireline 114 under gravitational forces until reaching the BHA 122 (FIG. 1). To ensure that it does not collide with the BHA 122 at a high velocity, the wireline jarring tool 124 may further include a wireline brake 304, shown in a disengaged state in FIG. 3, centrally located within the body 202 of the wireline jarring tool 124 and operable to grippingly engage the wireline 114. Upon approaching the BHA 122, the wireline brake 304 may be actuated to engage (tightly grip) the wireline 114 to slow the descent (speed) of the wireline jarring tool 124. Through the tightening (engaging) and loosening (disengaging) of the wireline brake 304, the travel speed of the wireline jarring tool 124 may be selectively controlled throughout the process of travelling downhole. Moreover, the wireline brake 304 may further prove advantageous in helping to ensure that there is no accidental shift of the wireline jarring tool 124 to the sides of the wellbore 106 that might cause the wireline 114 to be cut (severed).

In some embodiments, the wireline brake 304 may operate autonomously. In such embodiments, the wireline jarring tool 124 may include one or more proximity sensors 306 in communication with the wireline brake 304. In some embodiments, the proximity sensors 306 may comprise ultrasonic sensors, but could alternatively comprise other types of sensors or sensing devices capable of sensing and determining the approach of the BHA 122 (FIG. 1) as the wireline jarring tool 124 travels downhole. Once the proximity sensors 306 detect the presence of the BHA 122, a signal is sent to actuate the wireline brake 304 and thereby grip the wireline 114 to slow the descent of the wireline jarring tool 124.

In some embodiments, as illustrated, the proximity sensors 306 may be arranged at or near the lower end 204*b* of the body 202. In other embodiments, however, the proximity sensors 306 may be positioned at any other location on the body 202, without departing from the scope of the disclosure. Moreover, while two proximity sensors 306 are depicted in FIG. 3, more or less than two may be included in wireline jarring tool 124. In embodiments that include more than two proximity sensors 306, it is contemplated herein that the wireline jarring tool 124 may be used in non-vertical or deviated wells without losing accuracy.

In some embodiments, the wireline jarring tool 124 may further include a control system 308 housed within the body 202. The control system 308 may comprise, for example, a computer system including a microprocessor and memory configured to store and execute computer-readable instructions. The control system 308 may be in communication with the wireline brake 304 and the proximity sensors 306. Once the proximity sensors 306 detect the presence of the BHA 122, a signal is sent from the proximity sensors 306 to the control system 308, which communicates with and operates the wireline brake 304 and thereby slows (or stops) the descent of the wireline jarring tool 124.

The wireline jarring tool 124 may further include a jarring assembly 309 housed within the body 202 and operable to generate a jarring force that can be transmitted to the BHA 122 to free the BHA 122 from a stuck condition. As illustrated, the jarring assembly 309 includes one or more impact hammers 310 (two shown) designed to actuate and provide the jarring force transmitted to the BHA 122 (FIG. 1). The jarring assembly 309 may further include biasing devices or "spring jars" 312 actuatable to drive the impact hammers 310 vertically upward and thereby provide the desired jarring force. The spring jars 312 may be activated and otherwise operated with actuation tooling 314, which may be integrated into the spring jars 312 or the body 202. The actuation tooling 314 may be communicatively coupled to the control system 308, which may be programmed to activate the actuation tooling 314 and thereby operate the spring jars 312. The actuation tooling 314 may include, for example, one or more motors or servos configured to release potential energy stored in the spring jars 312, and thereby actuate the impact hammers 310. In particular, the actuation tooling 314 may include a servo that releases the spring jars 312 to accelerate the impact hammers 310, and may also include one or more motors operable to retract the spring jars 312 to re-set the impact hammers 310 for subsequent operation of the jarring assembly 309.

In some embodiments, operation of the actuation tooling 314 may be initiated based on a timer included in the control system 308, and otherwise on a predetermined time period. For example, the control system 308 may receive a signal that the upper end of the BHA 122 has been successfully received within the fish neck housing 302, at which point a timer included in the control system 308 may be initiated (started). The timer may be programmed with a predetermined time period (e.g., about 10 minutes) for the wireline jarring tool 124 to actuate. Upon expiration of the predetermined time period, a signal will be sent from the control system 308 to the actuation tooling 314 to release the spring jars 312. Upon release of the spring jars 312, the potential energy stored in the spring jars 312 may be released and therefore cause the impact hammers 310 to rapidly accelerate upward to provide a jarring force transmittable to the BHA 122. The impact hammers 210 may strike a portion of the body 202, such as the bottom interior face of the upper end 204*a*, in order to transmit the jarring force throughout the wireline jarring tool 124 and therefore into the BHA 122. In one or more embodiments, the motor of the actuation tooling 314 may be operable to retract the spring jars 312 after a jarring cycle, such that the spring jars 312 are reset and ready to perform additional jarring operations, if needed.

The wireline jarring tool 124 may further include a fish locking profile 316 operable to receive and secure an upper end of the BHA 122 (FIG. 1). More specifically, the fish locking profile 316 may comprise a radially actuatable member or component that allows the entry of the upper end of the BHA 122 into the fish neck housing 302, and is then actuatable to radially expand (extend) and thereby secure the top of the BHA 122 to the wireline jarring tool 124.

The fish neck housing 302 may effectively form or provide a pocket or chamber where the BHA 122 (FIG. 1) may be received to mate with the wireline jarring tool 124 such that the BHA 122 and the wireline jarring tool 124 may share the generated jarring motion. In some embodiments, the fish neck housing 302 may be angled and otherwise chamfered at the lower end 204*b* to provide a tool guide surface that may aid in the receipt and mating of the BHA 122 with the fish neck housing 302. Having the angled tool guide surface may prove advantageous in helping to guide entry of the BHA 122 into the fish neck housing 302.

The wireline jarring tool 124 may further include one or more tool sensors 318 (two shown) configured to determine when the BHA 122 (FIG. 1) has successfully entered the fish neck housing 302 and when the fish locking profile 316 has successfully locked the BHA 122 in place. In some embodiments, as illustrated the tool sensors 318 may be mounted to (or form a part of) the fish locking profile 316. In other embodiments, however, the tool sensors 318 may be positioned at any other location on the body 202, without departing from the scope of the disclosure. The tool sensors 318 may comprise, for example, electromagnetic sensors capable of determining the presence of the BHA 122.

The fish locking profile 316 and the tool sensors 318 may be in communication with the control system 308. Consequently, when the tool sensors 318 determine and otherwise provide a positive indication that the BHA 122 is properly received within the fish locking profile 316, a signal may be sent to the control system 308, which may send a command signal to the fish locking profile 316 two actuate and secure the BHA 122 within the fish locking profile 316. Moreover, when the tool sensors 318 determine that the fish locking profile 316 has successfully locked the BHA 122 within the fish locking profile 316, another signal may be sent to the control system 308 to start the timer for operation of the actuation tooling 314.

In some embodiments, a wire cutter 320 may be included in the wireline jarring tool 124. As illustrated, the wire cutter may be arranged below or downhole from the wireline brake 304. The wire cutter 320 may be in communication with the control system 308, and may be operated in instances in which operation of the wireline jarring tool 124 fails to free the BHA 122. In such scenarios, the wire cutter 320 may facilitate the cutting of the wireline 114 below the wireline brake 304, which also detaches the BHA 122 from the wireline 114. The wireline brake 304 and the fish locking profile 316 may be simultaneously signaled, such that the fish locking profile 316 is actuated to disengage from the BHA 122 and the wireline brake 304 is actuated to fully grip the wireline 114 to prevent the wireline jarring tool 124 from detaching from the wireline 114 after cutting. The wire cutter 320 may cut the wireline 114 to free the wireline jarring tool 124 from the BHA 122, which allows the wireline jarring tool 124 to be retrieved to the surface 104 (FIG. 1). After the retrieving the wireline jarring tool 124, traditional fishing operations may then be undertaken for retrieving the BHA 122.

Figure 4:
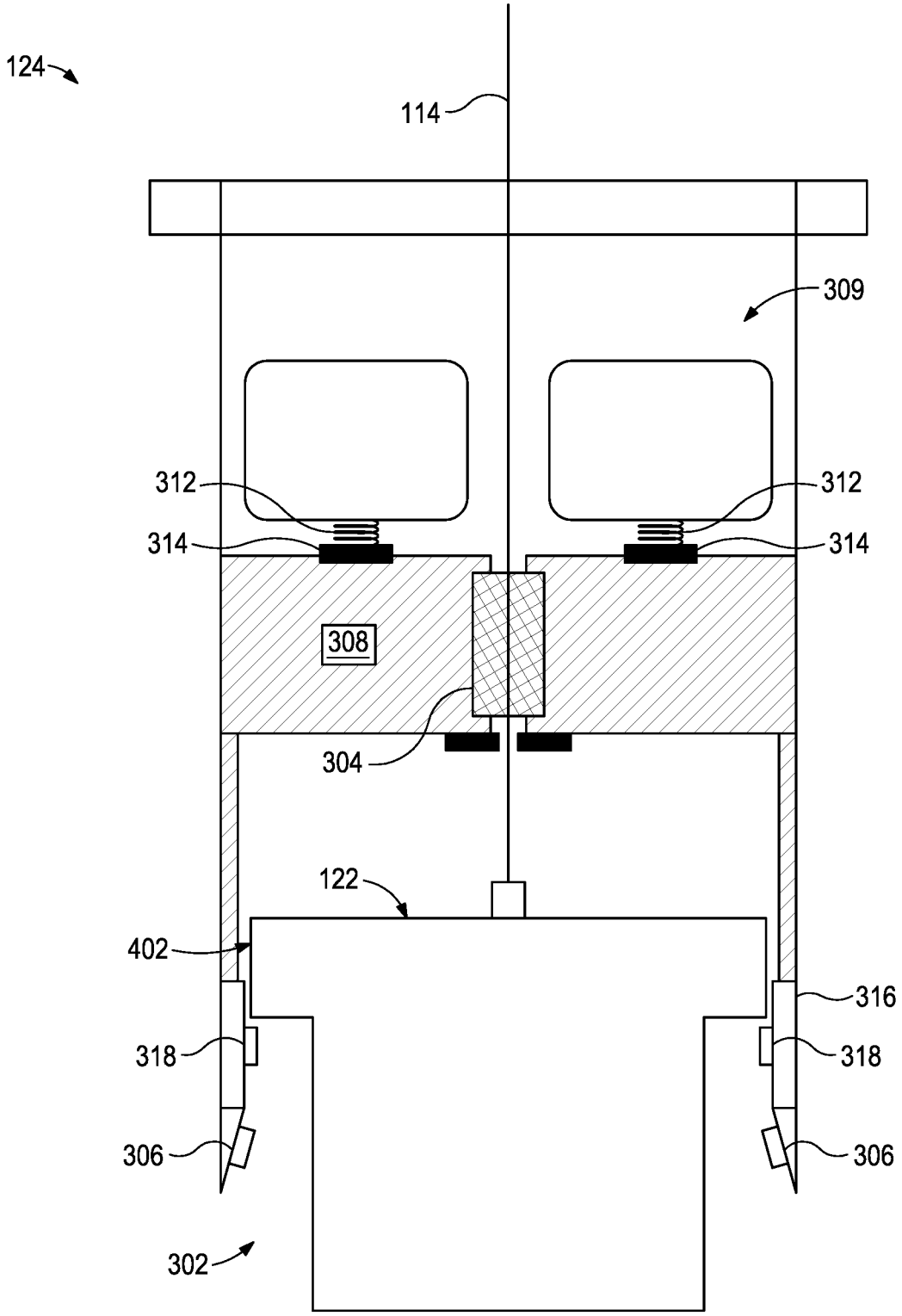
FIGS. 4-6 depict example, progressive operation of the wireline jarring tool of FIG. 3, according to one or more embodiments.
Figure 5:
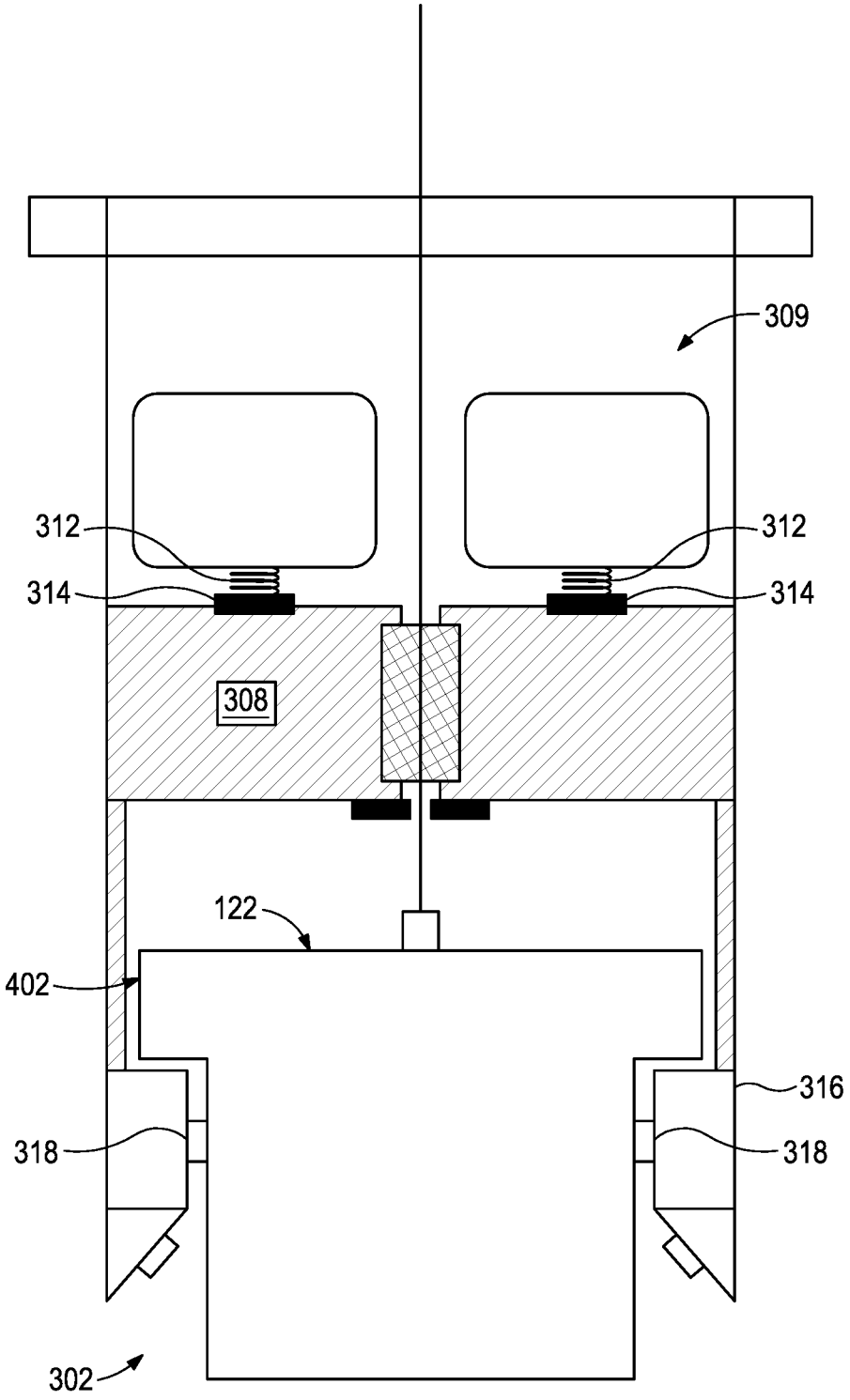
Figure 6:
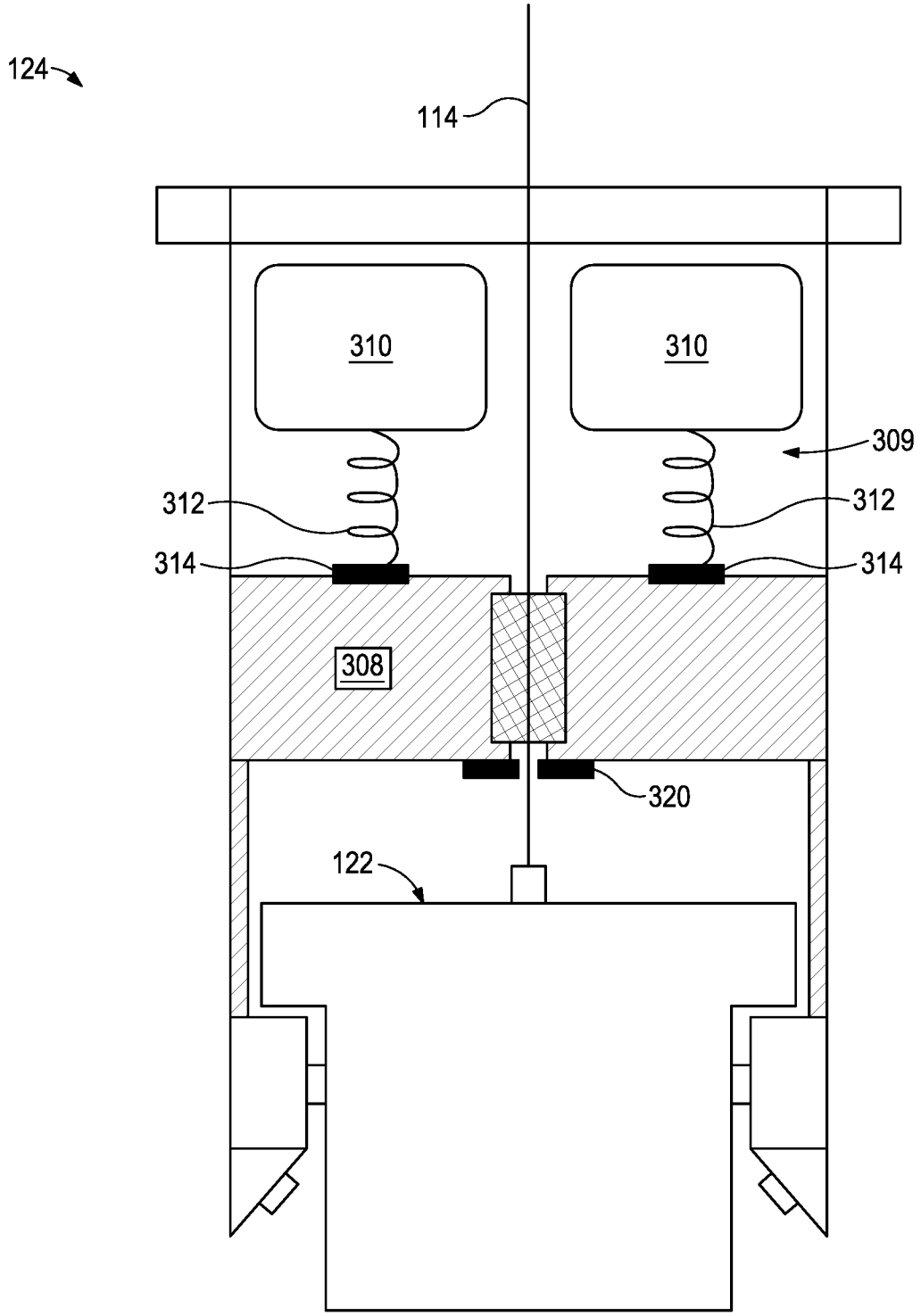

Example operation of the wireline jarring tool 124 will now be provided with reference to FIGS. 4-6, which depict a series of progressive cross-sectional side views of the wireline jarring tool 124, according to one or more embodiments. In FIG. 4, an upper end 402 of the BHA 122 is shown attached to a distal end of the wireline 114 and being received within the fish neck housing 302. Upon receiving the upper end 402 within the fish neck housing 302, the wireline jarring tool 124 may actuate and begin the jarring process to free the BHA 122, as described below.

In FIG. 4, the upper end 402 of the BHA 122 has entered the wireline jarring tool 124, which is in engagement mode. The proximity sensors 306 have previously determined the approach of the BHA 122 and the wireline brake 304 has actuated to slow the descent of the wireline jarring tool 124 to prevent damage to any of the downhole equipment. Upon reaching the tool guide surface and the fish locking profile 316, the presence of the BHA 122 has caused the collapse of the tool guide surface and the fish locking profile 316. The collapse of the tool guide surface and the fish locking profile 316 may have been performed directly by the force of the entering BHA 122, or may have actuated independently in response to a signal from the proximity sensors 306. Alternatively, the tool guide surface and the fish locking profile 316 may be sent downhole in the collapsed state. As the upper end 402 of the BHA 122 enters the fish neck housing 302, the tool sensors 318 may register the presence of the BHA 122, and once the fish locking profile 316 locks the upper end 402 in place within the fish neck housing 302, a signal may be sent to the control system 308 to commence operation of the jarring assembly 309 via the actuation tooling 314 of the spring jars 312.

In FIG. 5, the upper end 402 of the BHA 122 has fully entered the fish neck housing 302 and is secured in place by the fish locking profile 316. To accomplish this, both the fish locking profile 316 and the tool guide surface are expanded to allow the fish locking profile 316 to radially contact the upper end 402 of the BHA 122. The tool sensors 318 detect operation of the fish locking profile 316 and its subsequent locking, and communicate with the control system 308 to commence operation of the jarring assembly 309 via the actuation tooling 314 of the spring jars 312 to begin the timer for the jarring operation.

In FIG. 6, the wireline jarring tool 124 has actuated by releasing the spring jars 312, which rapidly accelerate the impact hammers 310 in the uphole direction, and thereby provide a jarring force from the jarring assembly 309 that is transmitted to the attached BHA 122. The initial jarring force resulting from actuation of the impact hammers 310 may free the BHA 122 from the wellbore. However, in the event that the BHA 122 is still stuck after the first (initial) jarring operation, the actuation tooling 314 may retract the spring jars 312 and the connected impact hammers 310 again such that the jarring assembly 309 returns to the initial firing position, as shown in FIG. 5. Once the spring jars 312 are re-set, another jarring operation may be undertaken. The retracting and firing process of the jarring assembly 309 may be performed several times in an attempt to free the BHA 122 from the wellbore. If the process is repeated without successfully freeing the BHA 122, the control system 308 may be programmed to send a signal to the wire cutter 320 to cut (sever) the wireline 114 to allow for extraction of the wireline jarring tool 124. In some embodiments, the control system 308 may be programmed to operate the wire cutter 310 after actuating the wireline jarring tool 124 a predetermined number of times; e.g., 5 times, 10 times, 20 times, or more.

Figure 7:
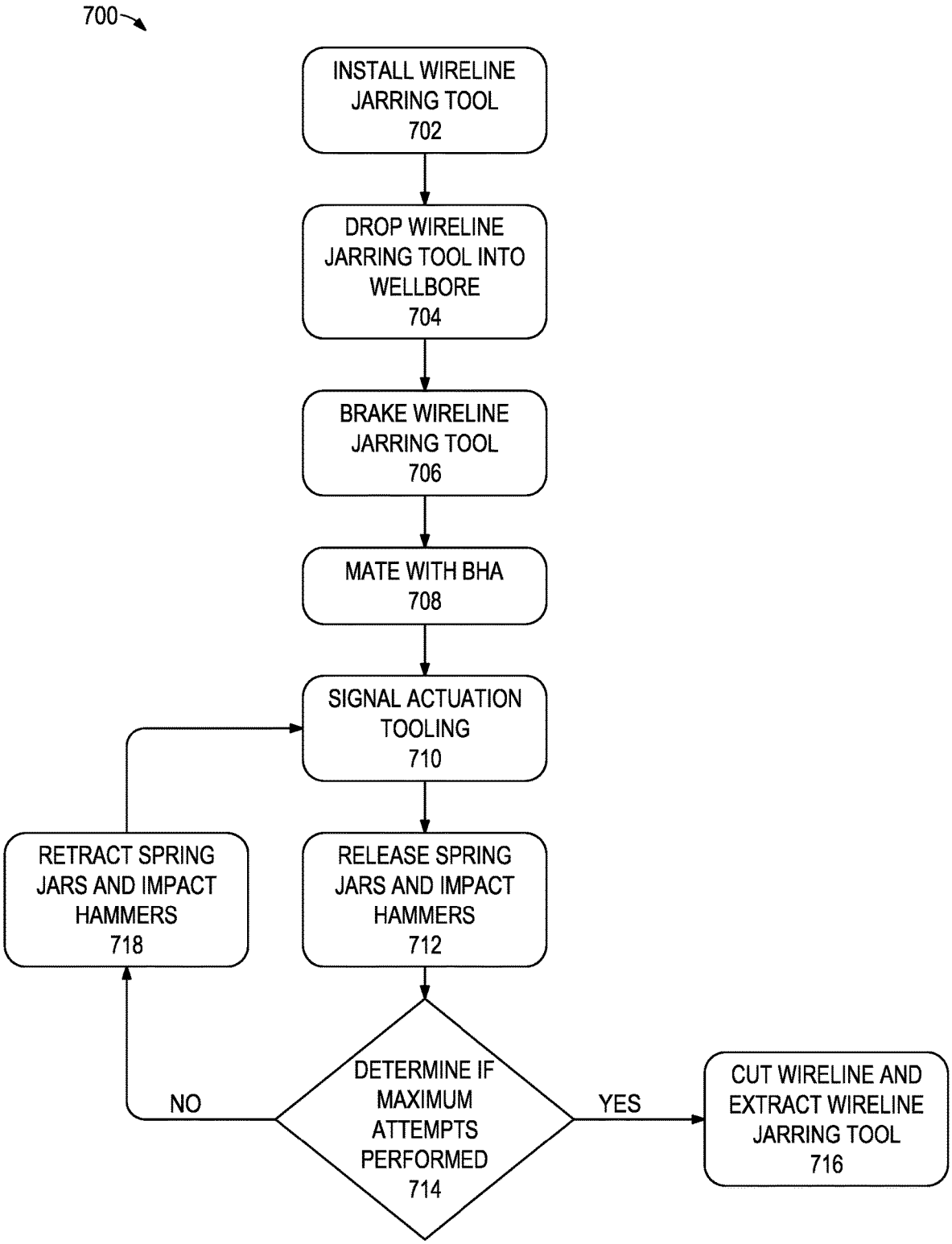
FIG. 7 is a schematic flowchart of an example method for jarring a BHA with a wireline jarring tool.

FIG. 7 is a schematic flowchart of an example method 700 for jarring a BHA (e.g., the BHA 122) with a wireline jarring tool. The method 700 may begin at 702 with the installation of a wireline jarring tool (e.g., the wireline jarring tool 124) onto a wireline (e.g., the wireline 114). The installation of the wireline jarring tool at 702 may include both the insertion of the wireline into the wireline jarring tool and the installation of locking caps (e.g., the locking caps 208) onto the wireline jarring tool to retain the wireline in place. At 704, the wireline jarring tool may be dropped into the wellbore while being guided by the wireline. The wireline jarring tool may be carried by gravity along the length of the wireline until approaching the BHA. At 706, a proximity sensor (e.g., the proximity sensors 306) on the wireline jarring tool may detect the approaching BHA and signal a wireline brake (e.g., the wireline brake 304) to brake and slow the travel of the wireline jarring tool. At 708, the wireline jarring tool may mate with the BHA through the collapsing of a fish locking profile (e.g., the fish locking profile 316) and subsequent locking of the fish locking profile to prevent the exit of the wireline tool from the wireline jarring tool.

At 710, a second set of sensors (e.g., the tool sensors 318) within the wireline jarring tool may send a signal to a control system, which instructs the actuation tooling of one or more spring jars (e.g., the actuation tooling 314 and spring jars 312) that the wireline tool is in place. The signal may further begin a timer to delay the actuation of the spring jars until a predetermined time has elapsed. At 712, the actuation tooling may release the one or more spring jars and the attached one or more impact hammers (e.g., the impact hammers 310). The release of the spring jars and the impact hammers may jar the wireline jarring tool and the mated BHA, such that the BHA may be jarred and freed. In the event that the jarring operation fails to free the BHA, at 714 the number of previous attempts is assessed and compared to a predetermined number of maximum attempts to determine if the jarring operation should continue. If the maximum number of jarring attempts has been performed, at 716 a wire cutter (e.g., the wire cutter 320) may be instructed to sever the wireline below the wireline brake to allow for the extraction of the wireline jarring tool. If the maximum number of jarring attempts has not been performed, the method may include resetting the spring jars at 718. The actuation tooling may include a motor which may retract the spring jars and impact hammers, such that the wireline jarring tool may perform a further jarring operation. The method may then proceed to 710 in order to repeat the signaling of the actuation tooling and start of another timer.

Embodiments Disclosed Herein Include:

A. A well system includes a wellhead including a lubricator and a wireline extending through the lubricator, a bottom hole assembly (BHA) attached to the wireline and conveyable into a wellbore extending from the wellhead, and a wireline jarring tool. The wireline jarring tool includes an elongate body having opposing upper and lower ends, a longitudinal channel defined in the elongate body and extending between the upper and lower ends and sized to loosely receive the wireline, and a jarring assembly housed within the elongate body and operable to generate a jarring force transmittable to the BHA once the wireline jarring tool is secured to the BHA. The wireline jarring tool is conveyable into the wellbore by translating longitudinally along the wireline, and actuating the jarring assembly is configured to release the BHA from a stuck position within the wellbore.

B. A method of jarring a bottom hole assembly (BHA) includes installing a wireline jarring tool onto a wireline extending from a wellhead into a wellbore extending from the wellhead, the BHA being coupled to a distal end of the wireline within the wellbore, dropping the wireline jarring tool into the wellbore and allowing the wireline jarring tool to translate longitudinally along the wireline until locating the BHA, mating the wireline jarring tool with the BHA, and actuating a jarring assembly included in the wireline jarring tool and thereby transmitting a jarring force to the BHA.

C. A wireline jarring tool includes an elongate body having opposing upper and lower ends, a longitudinal channel defined in the elongate body and extending between the upper and lower ends and sized to loosely receive a wireline, and a jarring assembly housed within the elongate body and operable to generate a jarring force transmittable to a bottom hole assembly (BHA) once the wireline jarring tool is secured to the BHA within a wellbore. The wireline jarring tool is conveyable into the wellbore by translating longitudinally along the wireline, and actuating the jarring assembly is configured to release the BHA from a stuck position within a wellbore.

Each of the embodiments A, B, and C may have one or more of the following additional elements in any combination: Element 1: further comprising one or more locking caps configured to prevent the wireline from migrating out of the longitudinal channel during operation. Element 2: wherein each locking cap comprises an annular ring with a slanted wire entry forming a break in the annular ring. Element 3: wherein at least one of the one or more locking caps is securable to an outer radial surface of the elongate body via a threaded interface. Element 4: wherein the jarring assembly comprises one or more impact hammers, and one or more spring jars actuatable to drive the one or more impact hammers and thereby generate the jarring force. Element 5: wherein the jarring assembly further comprises actuation tooling operable to release and retract the spring jars. Element 6: further comprising a control system communicatively coupled to the actuation tooling and programmed to activate the actuation tooling. Element 7: wherein the control system includes a timer programmed with a predetermined time period, and wherein upon expiration of the predetermined time period the control system sends a signal the actuation tooling to release the one or more spring jars. Element 8: wherein the jarring tool includes one or more impact hammers operable with one or more spring jars, and wherein actuating the jarring assembly includes releasing the one or more spring jars and thereby driving the one or more impact hammers to generate the jarring force to jar both the wireline jarring tool and the BHA. Element 9: further comprising resetting the one or more spring jars, and releasing the one or more springs jars a subsequent time. Element 10: further comprising detecting, via one or more proximity sensors, an approach of the BHA while the wireline jarring tool longitudinally translates along the wireline, and slowing motion of the wireline jarring tool with a wireline brake included in the wireline jarring tool. Element 11: wherein installing the wireline jarring tool onto the wireline comprises loosely receiving the wireline into a longitudinal channel provided by the wireline jarring tool, securing one or more locking caps onto the wireline jarring tool, and preventing the wireline from migrating out of the wireline jarring tool with the one or more locking caps. Element 12: further comprising detecting, via one or more tool sensors, that the BHA received within a fish neck housing defined by the wireline jarring tool, and signaling a timer to actuate the jarring assembly after a predetermined time has elapsed. Element 13: further comprising a wireline brake centrally located within the elongate body and operable to grippingly engage the wireline, one or more proximity sensors configured to detect an approach of the BHA and produce a signal to actuate the wireline brake. Element 14: further comprising a wire cutter arranged below the wireline brake and operable to sever the wireline. Element 15: further comprising a fish neck housing defined within a lower end of the elongate body and sized to receive an upper end of the BHA, and a fish locking profile operable to receive and secure the upper end of the BHA. Element 16: further comprising one or more tool sensors configured to determine when the BHA has entered the fish neck housing and when the fish locking profile has secured the upper end of the BHA. Element 17: wherein the fish neck housing is angled and otherwise chamfered at a lower end of the elongate body and thereby provides a tool guide surface for receiving and mating the BHA with the fish neck housing.

By way of non-limiting example, exemplary combinations applicable to A, B, and C include: Element 1 with Element 2; Element 2 with Element 3; Element 4 with Element 5; Element 5 with Element 6; Element 6 with Element 7; Element 8 with Element 9; Element 13 with Element 14; Element 15 with Element 16; and Element 15 with Element 17.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A well system, comprising:

a wellhead including a lubricator and a wireline extending through the lubricator;

a bottom hole assembly (BHA) attached to the wireline and conveyable into a wellbore extending from the wellhead; and a wireline jarring tool including:

an elongate body having opposing upper and lower ends;

a longitudinal channel defined in the elongate body and extending between the upper and lower ends and sized to loosely receive the wireline; and a jarring assembly housed within the elongate body and operable to generate a jarring force transmittable to the BHA once the wireline jarring tool is secured to the BHA, wherein the wireline jarring tool is conveyable into the wellbore by translating longitudinally along the wireline, and actuating the jarring assembly is configured to release the BHA from a stuck position within the wellbore.

2. The well system of claim 1, further comprising one or more locking caps configured to prevent the wireline from migrating out of the longitudinal channel during operation.

3. The well system of claim 2, wherein each locking cap comprises an annular ring with a slanted wire entry forming a break in the annular ring.

4. The well system of claim 3, wherein at least one of the one or more locking caps is securable to an outer radial surface of the elongate body via a threaded interface.

5. The well system of claim 1, wherein the jarring assembly comprises:

one or more impact hammers; and one or more spring jars actuatable to drive the one or more impact hammers and thereby generate the jarring force.

6. The well system of claim 5, wherein the jarring assembly further comprises actuation tooling operable to release and retract the spring jars.

7. The well system of claim 6, further comprising a control system communicatively coupled to the actuation tooling and programmed to activate the actuation tooling.

8. The well system of claim 7, wherein the control system includes a timer programmed with a predetermined time period, and wherein upon expiration of the predetermined time period the control system sends a signal the actuation tooling to release the one or more spring jars.

9. A method of jarring a bottom hole assembly (BHA), comprising:

installing a wireline jarring tool onto a wireline extending from a wellhead into a wellbore extending from the wellhead, the BHA being coupled to a distal end of the wireline within the wellbore;

dropping the wireline jarring tool into the wellbore and allowing the wireline jarring tool to translate longitudinally along the wireline until locating the BHA;

mating the wireline jarring tool with the BHA; and actuating a jarring assembly included in the wireline jarring tool and thereby transmitting a jarring force to the BHA.

10. The method of claim 9, wherein the jarring tool includes one or more impact hammers operable with one or more spring jars, and wherein actuating the jarring assembly includes releasing the one or more spring jars and thereby driving the one or more impact hammers to generate the jarring force to jar both the wireline jarring tool and the BHA.

11. The method of claim 10, further comprising:

resetting the one or more spring jars; and releasing the one or more springs jars a subsequent time.

12. The method of claim 9, further comprising:

detecting, via one or more proximity sensors, an approach of the BHA while the wireline jarring tool longitudinally translates along the wireline; and slowing motion of the wireline jarring tool with a wireline brake included in the wireline jarring tool.

13. The method of claim 9, wherein installing the wireline jarring tool onto the wireline comprises:

loosely receiving the wireline into a longitudinal channel provided by the wireline jarring tool;

securing one or more locking caps onto the wireline jarring tool; and preventing the wireline from migrating out of the wireline jarring tool with the one or more locking caps.

14. The method of claim 9, further comprising:

detecting, via one or more tool sensors, that the BHA received within a fish neck housing defined by the wireline jarring tool; and signaling a timer to actuate the jarring assembly after a predetermined time has elapsed.

15. A wireline jarring tool, comprising:

an elongate body having opposing upper and lower ends;

a longitudinal channel defined in the elongate body and extending between the upper and lower ends and sized to loosely receive a wireline; and a jarring assembly housed within the elongate body and operable to generate a jarring force transmittable to a bottom hole assembly (BHA) once the wireline jarring tool is secured to the BHA within a wellbore, wherein the wireline jarring tool is conveyable into the wellbore by translating longitudinally along the wireline, and actuating the jarring assembly is configured to release the BHA from a stuck position within a wellbore.

16. The wireline jarring tool of claim 15, further comprising:

a wireline brake centrally located within the elongate body and operable to grippingly engage the wireline; and one or more proximity sensors configured to detect an approach of the BHA and produce a signal to actuate the wireline brake.

17. The wireline jarring tool of claim 16, further comprising a wire cutter arranged below the wireline brake and operable to sever the wireline.

18. The wireline jarring tool of claim 15, further comprising:

a fish neck housing defined within a lower end of the elongate body and sized to receive an upper end of the BHA; and a fish locking profile operable to receive and secure the upper end of the BHA.

19. The wireline jarring tool of claim 18, further comprising one or more tool sensors configured to determine when the BHA has entered the fish neck housing and when the fish locking profile has secured the upper end of the BHA.

20. The wireline jarring tool of claim 18, wherein the fish neck housing is angled and otherwise chamfered at a lower end of the elongate body and thereby provides a tool guide surface for receiving and mating the BHA with the fish neck housing.

* * * * *